US005131435A

United States Patent [19]

Takegawa

[11] Patent Number: 5,131,435

[45] Date of Patent: Jul. 21, 1992

[54] ON LOOM WARP MENDING OPERATION

[75] Inventor: Yujiro Takegawa, Ishikawa, Japan

[73] Assignee: Tsudakoma Corporation, Ishikawa, Japan

[21] Appl. No.: 687,693

[22] Filed: Apr. 19, 1991

[30] Foreign Application Priority Data

Apr. 19, 1990 [JP] Japan ..... 2-104282

[51] Int. Cl.[5] ..... D03J 1/14

[52] U.S. Cl. ..... 139/35; 139/1 R; 139/351

[58] Field of Search ..... 364/470; 139/1 R, 35, 139/351, 353; 28/211, 209

[56] References Cited

U.S. PATENT DOCUMENTS

| | | | |
|---|---|---|---|
| 4,817,675 | 4/1989 | Dewaele et al. | 28/209 X |
| 4,905,737 | 3/1990 | Gryson | 139/35 |
| 4,967,801 | 11/1990 | Gryson | 139/35 |

FOREIGN PATENT DOCUMENTS

| | | |
|---|---|---|
| 0259915 | 8/1987 | European Pat. Off. . |
| 62-69851 | 3/1987 | Japan . |
| 63-28951 | 2/1988 | Japan . |
| 1-24659 | 5/1989 | Japan . |
| 1-192853 | 8/1989 | Japan . |
| 2-210045 | 8/1990 | Japan . |

*Primary Examiner*—Andrew M. Falik
*Attorney, Agent, or Firm*—Wenderoth, Lind & Ponack

[57] ABSTRACT

A warp mending operation control method includes the steps of: dividing a warp line in a loom into a plurality of sections each corresponding to a respective one of a plurality of warp mending devices; storing operation programs for controlling the respective warp mending devices corresponding to the plurality of sections and detecting the section where the warp line is broken; and driving the warp mending device which has been positioned in the section in which a broken warp line has been detected after reading the operation program corresponding to that section. A warp mending operation control apparatus includes: a memory for storing operation programs for controlling warp mending devices each positioned in corresponding sections provided by dividing a warp line in a loom, the mending devices for mending a broken warp line having leading and trailing edges; a suction nozzle with a yarn sensor which is movable to both the leading and trailing edges of the broken warp line in both the width direction of the loom and the direction of the warp upon reception of a warp stop signal issued by a warp stop motion; a breakage section judging unit for judging a breakage section where the warp line is broken upon reception of a detected signal issued by the yarn sensor and a selection control unit for reading the operation programs corresponding to the thus judged breakage section out of the memory and for driving the warp mending device positioned at the breakage section.

5 Claims, 4 Drawing Sheets

ON LOOM WARP MENDING OPERATION

BACKGROUND OF THE INVENTION

1. Field of the Invention

The present invention relates to a warp mending operation control method for detecting a breakage position of a warp on a warp line and for operating a corresponding warp mending device, and an apparatus for carrying out the control method.

2. Description of the Prior Art

There have been proposed various methods for mending a warp on a warp line. These methods are however applicable to a specific breakage position on the warp line but not applicable to any breakage position on the warp line whereby there exists a position where the broken warp can not be mended.

For full automation of the warp mending operation, it is necessary to divide the warp line in the direction of the warps into appropriate sections and to provide mending devices corresponding to each section. When one of the mending devices is actuated, the section where a warp is broken is to be specified in the direction of the warps.

SUMMARY OF THE INVENTION

Accordingly, it is an object of the present invention to specify one of the sections on the warp line where one of the warps is broken (hereinafter referred to as a breakage section) and to selectively operate one of mending devices provided at the breakage section so that the full automation of the warp mending operation can be effected.

To achieve the above object, the warp mending operation control method according to the present invention comprises the steps of dividing a warp line on a loom into a plurality of sections corresponding to each of warp mending devices, storing operation programs for a warp mending operation in response to each of the divided sections, detecting the breakage section at the time when the warp is broken, reading the operation programs for a warp mending operation (hereinafter referred to as an operation program) in response to the detected breakage section to operate the corresponding warp mending device.

Accordingly, an appropriate warp mending device is operated for each breakage section, thereby enabling the warp mending device to mend the broken warp at any breakage position.

The warp mending operation control apparatus according to the present invention comprises a memory for storing operation programs for mending the broken warp, a yarn sensor for detecting a breakage section and issuing a detection signal, a breakage section judging unit for judging the breakage section on the basis of the detection signal issued by the yarn sensor and a selection control unit for reading the corresponding operation program out of the memory on the basis of the judged breakage section to thereby actuate an appropriate mending device.

When the warp is broken, the let-off control unit for controlling the yarn sensor provided with a suction nozzle moves the yarn sensor in the width direction of the loom to the position where the warp is broken, and thereafter moves the yarn sensor in the direction of the warp, thereby detecting the breakage portion of the broken warp. The breakage section judging unit specifies the breakage section on the basis of the presence of the detection signal issued by the yarn sensor, for example, the breakage section is specified on the basis of the position at the time when the detection signal is issued. On the basis of the specified breakage section, the selection control unit reads the operation program corresponding to the specified breakage section out of the memory and supplies the thus read operation program to the warp mending device.

The warp mending operation method according to the present invention comprises the steps of detecting the breakage portion of the broken warp on the warp line by the yarn sensor, selectively reading the appropriate operation program by the selection control unit out of the memory in response to the breakage section, supplying the read operation program to the warp mending device so that an appropriate mending operation can be automatically effected even if the warp is broken at any position on the warp line. As a result, the loom can be restarted with assurance.

The above and other objects, features and advantages of the present invention will become more apparent from the following description taken in conjunction with the accompanying drawing.

DESCRIPTION OF THE PREFERRED EMBODIMENT

A warp mending operation control method and an apparatus for carrying out the same according to a preferred embodiment of the present invention will be described first with reference to FIGS. 1 and 2.

Figure 1:
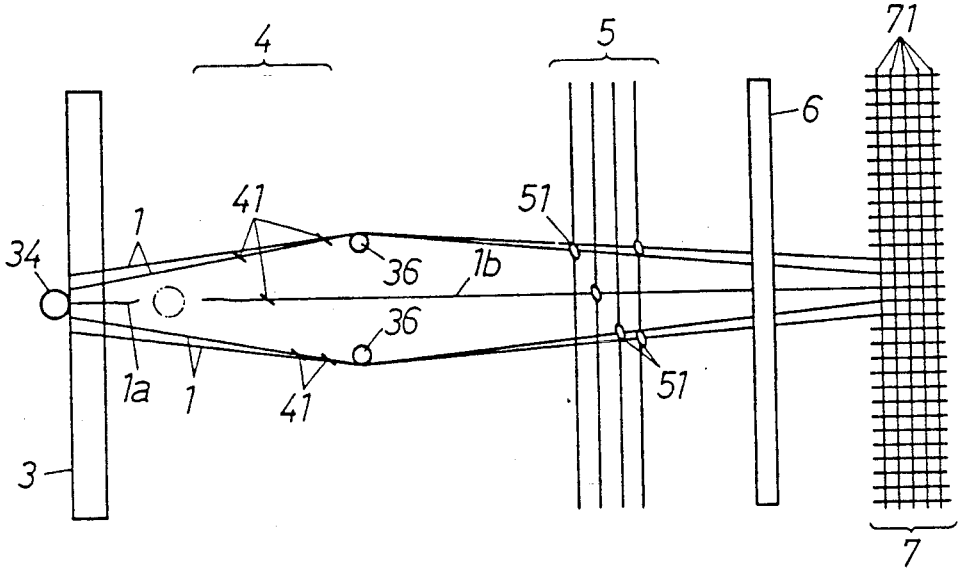
FIG. 1 is a plan view showing a warp line where a warp is broken.
Figure 2:
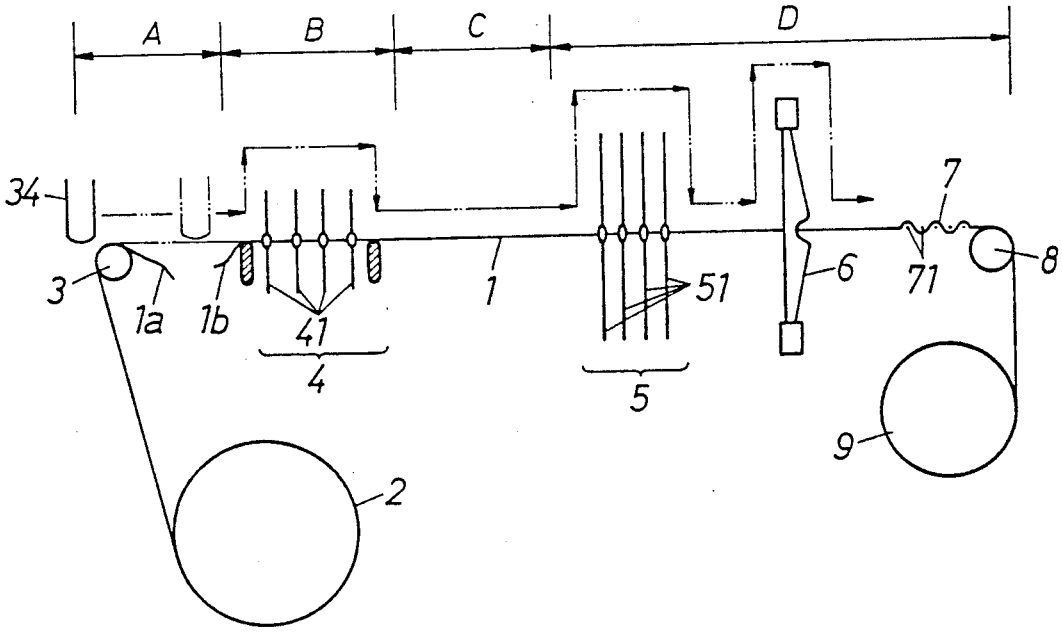
FIG. 2 is a side view showing the warp line where the warp is broken.

FIG. 1 is a plan view showing a warp line where a warp is broken;

A plurality of warps 1 are let off from a let-off motion 2 and contact a back-roller 3 and are drawn through dents of a reed 6 via drop wires 41 of a warp stop motion and heddles 51 of a shedding device 5 and interlaced with wefts 71 to weave fabric 7 and thereafter wound around a take-up roller 9 via a guide roller 8.

Figure 3:
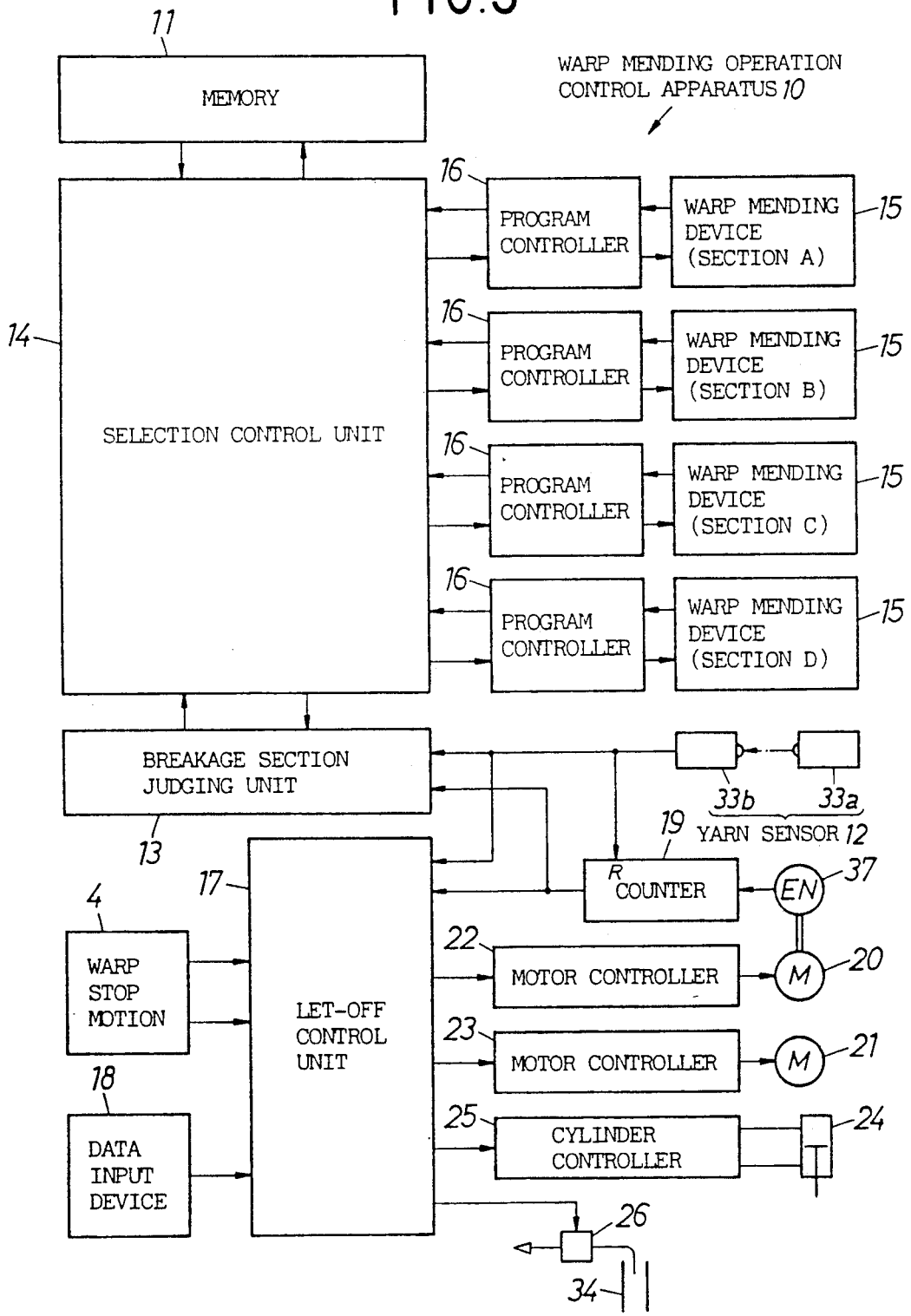
FIG. 3 is a block diagram showing a warp mending operation control apparatus according to a preferred embodiment of the present invention.

FIG. 3 shows an electrical arrangement of a warp mending operation control apparatus 10 according to the present invention.

The warp mending operation control apparatus 10 comprises a memory 11 for storing a plurality of operation programs, a yarn sensor 12 supported by a suction nozzle 34, described later, for detecting a breakage portion of the warp 1, a breakage section judging unit 13 for judging an appropriate breakage section on the basis of suction nozzle's moving range from the origin where the suction nozzle 34 is initially positioned (hereafter referred to as origin) to the position where the detected signal is issued by the yarn sensor 12, a selection control unit 14 for selecting an appropriate operation program corresponding to the appropriate breakage section, program controllers 16 for driving a plurality of warp mending devices 15, e.g. four devices in this embodiment, and a let-off control unit 17 of the yarn sensor 12 for controlling the operation of the suction nozzle 34 (hereinafter referred to as the let-off control unit). The let-off control unit 17 is connected to the warp stop motion 4, a data input device 18, and a counter 19 at the input side thereof and to motor controllers 22 and 23 for controlling motors 20 and 21, a solenoid valve 26 of a suction nozzle 34, described later, and a cylinder controller 25 for controlling a cylinder 24 at the output side thereof.

Figure 4:
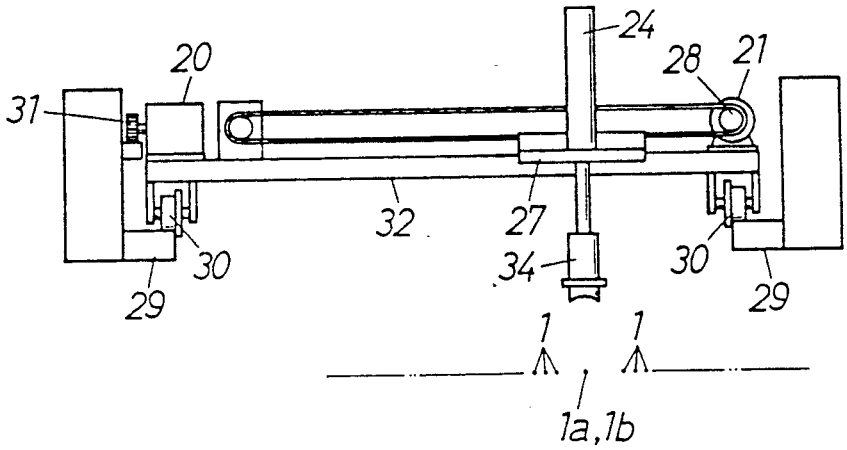
FIG. 4 is a front view showing a yarn sensor provided at a movable table.
Figure 5:
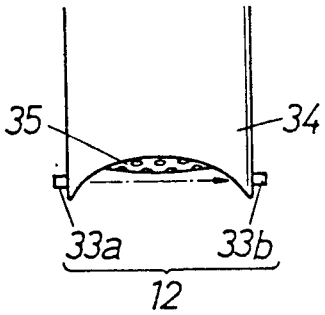
FIG. 5 is an enlarged front view of the yarn sensor of FIG. 4.
Figure 6:
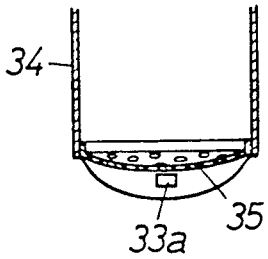
FIG. 6 is an enlarged cross sectional view of the yarn sensor of FIG. 4.
Figure 7:
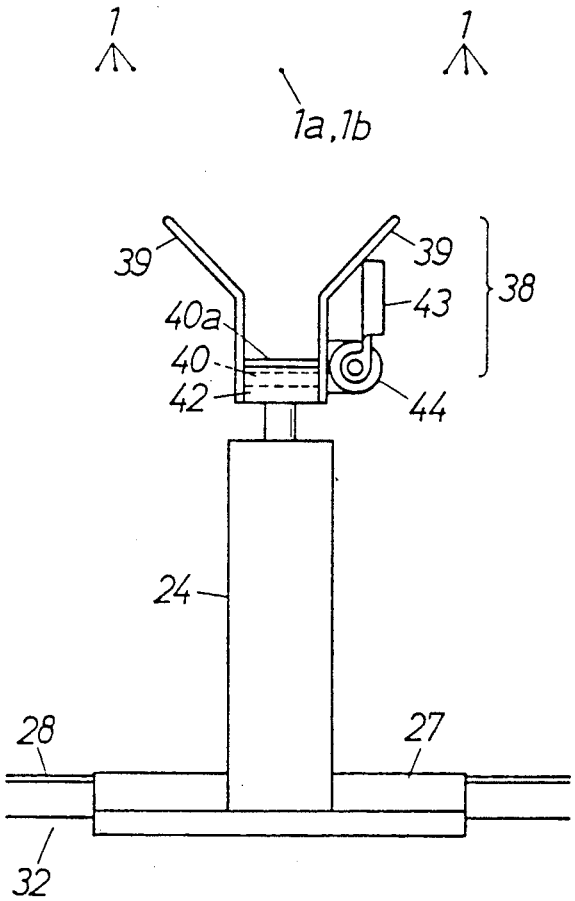
FIG. 7 is an enlarged front view showing a yarn sensor provided at a movable table according to another embodiment of the present invention.
Figure 8:
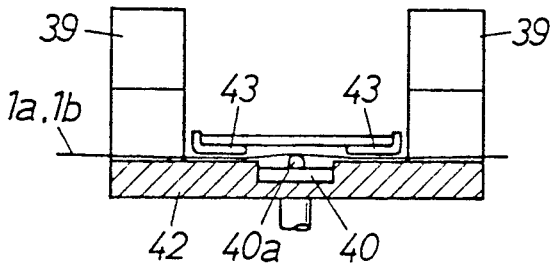
FIG. 8 is an enlarged cross sectional view of the yarn sensor of FIG.7.

The yarn sensor 12 is, as illustrated in FIG. 4, supported so as to be raised and lowered by a vertical cylinder 24 attached to a slider 27 on a movable table 32 and also supported so as to be positioned in the width direction of the loom by an endless belt 28 and the motor 21. The movable table 32 can be moved on rails 29 in the direction of warp line by wheels 30 and a rack and pinion 31. The yarn sensor 12 is, as illustrated in FIGS. 5 and 6, composed of a photo-emitter 33*a* and a photo-detector 33*b* which confront each other at a lower end portion of the suction nozzle 34. The suction nozzle 34 has the lower end portion which is notched in a circular arc shaped recess viewed from the warp 1 side and an opening surface closed by a perforation plate 35.

When the warp 1 is broken in a weaving operation, a dropper 41 corresponding to the broken warp 1 is dropped so that a warp stop signal is issued and the loom is automatically stopped at a predetermined stopping angular position.

Subsequently, a yarn separating device, not shown, composed a device such as the device illustrated, for example in Japanese laid-open patent publication number 62-69851 which reciprocates the dropped dropper 41 in the width direction of the loom, or a device as illustrated, for example, in Japanese laid-open publication number 63-28951 which twists the dropped dropper 41, thereby separating normal warps 1 adjacent to the broken warp 1 from the broken warp 1.

Thereafter, a pair of separating members 36 are, as illustrated in FIG. 1, inserted from below the warps in small slits on the opposite sides of the broken warp 1, i.e., the trailing and leading edges of the broken warp 1, so that the pair of separation members 36 are respectively moved in the width direction of the loom so as to be moved more away from both the trailing and leading edges of the broken warp 1. As a result, both the trailing and leading edges 1*a* and 1*b* of the broken warp 1 have a sufficient interval relative to the other normal warps 1 and are in a condition that both the trailing and leading edges 1*a* and 1*b* are easily picked up. The pair of separating members 36 are, for example, composed of a separating device as disclosed in Japanese laid-open patent publication number 1-192853 which is moved by a belt in the width direction of the loom and the separating members 36 are raised by a vertically movable pneumatic cylinder and further driven by a laterally movable pneumatic cylinder, i.e. capable of moving in the weaving width so as to be moved away from the warp 1.

The let-off control unit 17 receives data representing the position of the broken warp 1 with respect to the width of the loom on the basis of the dropped dropper's position from the device, for example, such as the dropping position measuring means illustrated in Japanese patent publication number 2-10143 or the two known devices, i.e. the separating device or separating members set forth above provided at the side of the warp stop motion 4. The let-off control unit 17, upon reception of the positional data, gives commands represents the moving range of the width direction of the loom extending from the stand-by position of the suction nozzle 34 to the position of the broken warp 1 to the motor controller 23 that the suction nozzle 34 is moved substantially over the broken warp leading and trailing edges 1*a* and 1*b*. Successively, the suction nozzle 34 is driven by the motor controller 22 so that the motor 20 is moved to the position adjacent to the back roller 3 which serves as an original position. Thereafter, the cylinder controller 25 is actuated to operated the cylinder 24 so that the suction nozzle 34 is lowered to approach the trailing edge 1*a* of the broken warp 1 while a solenoid valve 26 is operated to generate air current in the suction nozzle 34 in the suction direction so that the trailing edge 1*a* of the broken warp 1 is always attracted by the suction nozzle at the outer surface of the perforation plate 35, the yarn sensor 12 probes the breakage portion of the broken warp 1. An operator has previously operated the data input device 18 so that the data stores the moving range and moving speed of the suction nozzle 34 from the original position to where corresponding to the sections A, B, C and D where the four warp mending devices 15 are assigned. These sections A, B, C and D are set as respectively one unit in which different mending operations are normally effected along warp line. Accordingly, the let-off control unit 17 moves the suction nozzle 34 for the section A along the trailing edge of the broken warp 1, and thereafter raises the yarn sensor 12 by the cylinder 24 so that the suction nozzle 34 gets over the obstacle of the warp stop motion 4, and successively lowers the suction nozzle 34. Subsequently, similar operations are carried out in sections C and B while avoiding or getting over the obstacles by moving the yarn sensor 12 along both the trailing and leading edges 1*a* and 1*b* of the broken warp 1. The moving range of the suction nozzle 34 can be confirmed by the counter 19 which counts pulses issued by a shaft encoder 37 connected to the motor 20. The counter 19 can be reset when breakage of the warp 1 is confirmed by the warp stop motion 4.

The breakage section judging unit 13 receives the counted value issued by the counter 19 while the yarn sensor 12 probes both the trailing and leading edges 1*a* and 1*b* of the broken warp 1 in sections A, C and D of the warp line. When the yarn sensor 12 detects the breakage of the warp 1, the yarn sensor 12 issues a discontinuous signal which is input to the counter 19. The breakage section judging unit 13 reads the counted value issued by the counter 19 corresponding to the discontinuous signal as the breakage position of the warp 1, i.e., the positions of both the trailing and leading edges 1*a* and 1*b* and compares the counted value with the data of sections A, C and D, and thereafter determines the section that the breakage position is located at, e.g., section A, and supplies a signal corresponding to section A to the selection control unit 14. The selection control unit 14 reads the operation program corresponding to the breakage section out of the memory 11 and transfers the thus read operation program to the program controller 16 for the yarn mending device 15 corresponding to section A. The program controller 16 operates, upon reception of the operation program, the yarn mending device 15 on the basis of the predetermined operation program so that the yarn mending device 15 can mend broken yarn 1. Although the yarn sensor did not detect section B, the selection control unit 14 selects the yarn mending device 15 corresponding to section B since the breakage position of the warp 1 is considered to be section B if the breakage portion, i.e., both the trailing and leading edges of the warp 1 are not detected at any of the sections A, C and D.

That is, the warp mending operation method in the section A is, for example, disclosed in Japanese laid-open patent publication No. 1-124659 wherein a mending yarn having an appropriate length is connected at one end thereof to the trailing edge 1*a* of the broken warp 1 and at the other end to the leading edge 16 of the broken warp 1 while absorbing the slack of the mending yarn. The warp mending operation method in the section B is, for example, disclosed in European Patent Publication No. 0259915 wherein a new yarn is inserted into thread holes of the dropper 41 and connected to the trailing edge of the broken warp 1, then inserted into thread holes of the heddles 51 of the shedding device 5 while the dropper 41 is turned and thereafter the new yarn is connected to the leading edge 1*b* of the broken warp 1. It is necessary to previously remove both the trailing and leading edges 1*a* and 1*b* of the broken warp 1 from the dropper 41 and the heddle 51.

The mending operation in section C is, for example, disclosed in Japanese laid-open patent publication No. 1-192853 wherein a new mending yarn is connected to both the trailing and leading edges 1*a* and 1*b* of the broken warp 1 while the slack of the mending yarn is absorbed. The mending operation in the section D is, for example, disclosed in Japanese patent application No. 1-24673 wherein a mending yarn is connected to the trailing edge 1*a* of the broken warp 1 at one end thereof and positioned to the portion adjacent to the warp stop motion 4 at the other end thereof, then drawn into thread holes of the heddle 51 and specific dents of the reed. At this time both the trailing and leading edges 1*a* and 1*b* of the broken warp 1 are preferably extracted from the heddle 51 and the dents of the reed.

Each of the starting point of the sections A and B is determined by sufficiently securing sections between the starting points A and B to the threading hole of the dropper 41 and the heddle 51 so that the leading edge 1*b* of the broken warp 1 inserted into the thread holes of the dropper 41 and the heddle 51 can be connected to the mending yarn.

According to the above embodiment, both the trailing and leading edges of the broken warp 1 are not substantially probed by the yarn sensor at the shedding device 5. The improvement of the embodiment has an extra section within the section B which corresponds to the position of the shedding device 5 and the new section D is provided at the portion where the portion corresponding to the shedding device 5 is excluded from the aforementioned section D wherein when the breakage portion of the warp 1 is positioned in the extra section within the section B. The warp mending operation may be carried out in the same way as the embodiment set forth above.

Although the yarn sensor 12 is incorporated in the suction nozzle 34 according to the present embodiment, it may be incorporated into a yarn clamper 38. That is, the yarn clamper 38 can be moved from the lower portion to the upper portion of the warp 1 by the vertically movable cylinder 24 and restrains the broken warp 1 between a pair of guide pieces 39 and holds the broken warp 1 between a receiving piece 42 and two pressers 43 while the presence of the broken warp 1 is detected by a contact portion 40*a* of a pressure sensitive sensor 40 between two pressers and the breakage portion is probed. The two pressers 43 are driven by a rotary solenoid 44.

If the warp mending device 15 can perform the mending operation in all of the sections A, B, C and D, the warp mending device 15 can be composed of single device with a plurality of operation programs.

The yarn sensor 12 is commonly provided throughout the sections A, B, C and D according to the present embodiment, but it can be provided independently in each of the sections A, B, C and D. In this case, the probing operation of the breakage portion is effected simultaneously in sections A, B, C and D. With such an operation, it is not necessary to find the moving range of the yarn sensor 12 in the embodiment set forth above because the breakage section judging unit can judge the breakage section from the section where the yarn sensor, which judged the breakage portion, is positioned.

If there is only a single yarn sensor 12, it is not necessary to detect the moving range of the yarn sensor 12, but another sensor may detect the section to which the yarn sensor 12 is positioned at the time when the breakage portion is detected. It is also possible to detect the section on the basis of the proceedings of execution of the control programs at the time of issue of the detected signal.

The method for obtaining breakage position is not limited to the embodiments set forth above but there is a method to instantly detect the breakage position of the warp 1 arranged in a sheet as a default portion of the warp using an image sensor and to find the position of such a breakage position.

There are many kinds of embodiments for setting the sections and yarn mending operations in each of the sections in addition to the embodiments set forth above.

What is claimed is:

1. A warp mending operation control method comprising the steps of:

dividing a warp line in a loom into a plurality of sections each corresponding to a respective one of a plurality of warp mending devices;

storing operation programs for controlling the respective warp mending devices corresponding to the plurality of sections;

detecting the section where the warp line is broken;

positioning the warp mending device in the section in which a broken warp line has been detected and driving the warp mending device so as to mend the warp after reading the operation program corresponding to that section.

2. A warp mending operation control apparatus comprising:

a memory for storing operation programs for controlling warp mending devices each positioned in corresponding sections provided by dividing a warp line in a loom, said mending devices for mending a broken warp line having leading and trailing edges;

a suction nozzle with a yarn sensor including means for being movable to both the trailing and leading edges of the broken warp line in the width direction of the loom and then to the direction of the warp upon reception of a warp stop signal issued by a warp stop motion;

a breakage section judging unit for judging that a section is a breakage section having a broken warp line upon reception of a detected signal issued by the yarn sensor; and a selection control unit for reading the operation programs corresponding to the thus judged breakage section from the memory and for driving the warp mending device positioned at the breakage section.

3. A warp mending control apparatus according to claim 2, wherein the yarn sensor comprises a photo-emitter and a photo detector which are both attached to a suction portion of said suction nozzle.

4. A warp mending operation control apparatus according to claim 2, wherein the yarn sensor comprises a pressure sensitive sensor which is attached to a portion of a yarn clamper where the yarn is clamped by said yarn clamper.

5. A warp mending operation control apparatus according to claim 2, wherein a let-off operation of the suction nozzle in the direction of the warp is effected by a let-off control unit, a motor control unit driven by the let-off control unit and a motor.

* * * * *